United States Patent [19]

Trezza

[11] Patent Number: 5,009,051

[45] Date of Patent: Apr. 23, 1991

[54] CLIP CONSTRUCTION FOR ALIGNING SIDING SECTIONS

[76] Inventor: Ronald F. Trezza, P.O. Box 764, Melville, N.Y. 11747

[21] Appl. No.: 424,677

[22] Filed: Oct. 20, 1989

[51] Int. Cl.[5] ..... E04B 1/41; E04C 5/18

[52] U.S. Cl. ..... 52/410; 52/35; 52/309.4; 52/357; 52/487; 52/593; 52/714; 52/747; 52/765

[58] Field of Search ..... 52/410, 483, 357, 487, 52/539, 593, 714, 715, 765, 309.4, 35, 747

[56] References Cited

U.S. PATENT DOCUMENTS

| | | | |
|---|---|---|---|
| 1,366,470 | 1/1921 | Lampert | 52/714 |
| 2,237,212 | 4/1941 | Birdsong | 52/357 |
| 3,134,197 | 5/1964 | McColley | 52/35 |
| 3,525,189 | 8/1970 | Nelsson | 52/410 |
| 4,407,104 | 10/1983 | Francis | 52/309.4 |
| 4,641,473 | 2/1987 | Trezza | 52/410 |

FOREIGN PATENT DOCUMENTS

| | | | |
|---|---|---|---|
| 1362525 | 4/1963 | France | 52/483 |
| 832691 | 4/1960 | United Kingdom | 52/483 |
| 2051911 | 1/1981 | United Kingdom | 52/714 |

*Primary Examiner*—John E. Murtagh
*Assistant Examiner*—Deborah McGann Ripley

[57] ABSTRACT

A wall construction is provided which includes a wall upon which are located siding sections to which are fastened brick sections. The siding sections are arranged in coplanar end-to-end relationship and include abutting ends with nesting tongue and groove arrangements to resist relative transverse movement between the sections. The tongue defines a passage extending transversely across the same. A clip is provided which includes a central portion located between the ends of the siding sections. The central portion extends through the aforementioned passage in the tongue. The clip includes further portions extending in opposite directions from the central portion along opposite sides of the siding sections. A protruding flange is provided which extends outwardly from the first further portion and a settable material is provided adjacent the siding sections. The protruding portion is embedded in the settable material. A further holdback and alignment flange extends from the aforementioned central portion in opposite direction from the first further portion of the clip for holding one of the siding sections against the wall. The method associated with the foregoing structure involves compressing the tongue to form a strengthened compressed portion bordering the aforementioned passage to strengthen the same.

29 Claims, 2 Drawing Sheets

FIG. 2
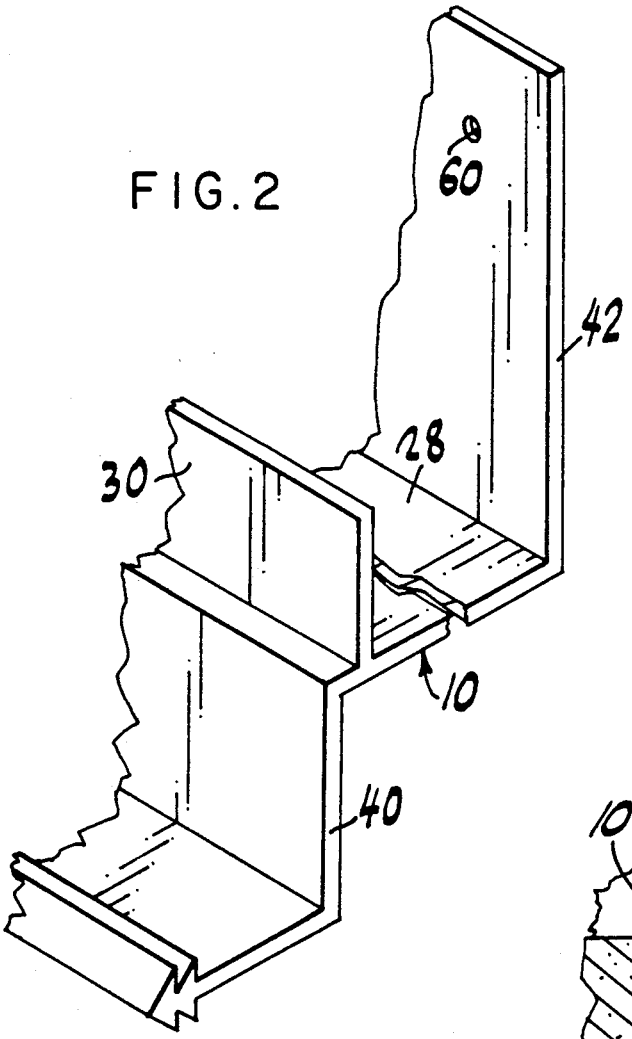
FIG. 4
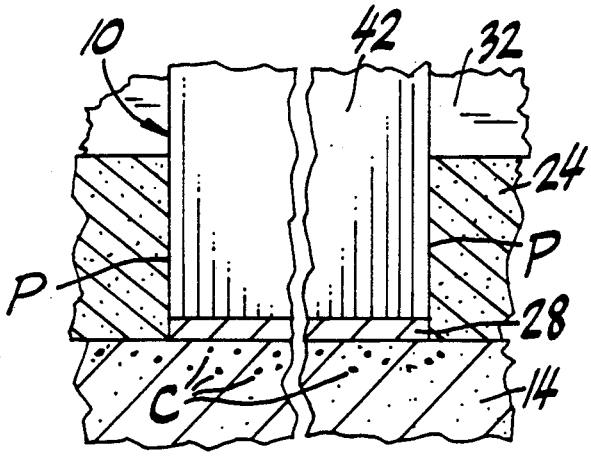
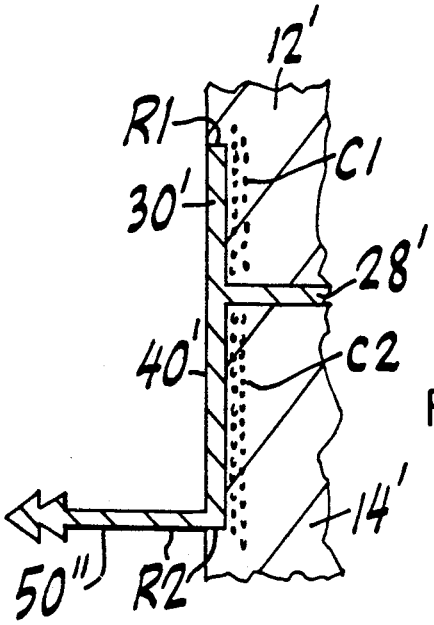
FIG. 5

CLIP CONSTRUCTION FOR ALIGNING SIDING SECTIONS

FIELD OF INVENTION

This invention relates to clip constructions and more particularly to clips adapted for aligning siding sections while also providing an anchorage for settable materials, for example, inserted between bricks, which cover such siding sections.

BACKGROUND

In U.S. Pat. No. 4,407,104, G. Francis discloses a brick panel wall construction including a backing board for a brick panel which is formed of plastic foam. The wall construction includes a number of brick panels having plastic foam backing boards and what is termed to be "load bearing" clip members that support the bricks which are secured to the backing boards. The load bearing clip members are sandwiched within the tongue and groove joints between adjacent upper and lower brick panels. Each clip includes a protruding terminal lip that extends into the joint area between bricks of adjacent panels wherein is packed mortar to cover the protruding lips of the clips. These clips become, according to G. Francis, the support for the bricks that are secured to the plastic foam backing boards.

In my own prior U.S. Pat. No. 4,641,473 I have disclosed a clip structure which is different from the Francis clip structure in providing a clamping structure for clamping the foam siding or backing boards against the associated supporting structure and in that an anchoring structure is provided which is offset from the joint zone between adjacent siding panels or backing boards. The arrangement is such that at the outer surface of the siding panels adjacent the joint therebetween there is provided in place of the anchoring structure of the Francis clip an L-shaped structure which depends from a central portion of the clip and extends downwardly along one of the adjacent and corresponding siding panels. The toe of the L-shaped clip bears thereupon an arrow-shaped anchor which includes or defines grooves which run parallel to the siding panels.

A large number of other U.S. Patents have also been located which reveal different types of clip constructions adapted for use with endwise abutting wall sections or the like. These patents include U.S. Pat. Nos. 1,662,177; 1,791,639; 1,939,528; 2,648,103; 3,102,366; 3,134,197; 3,608,263; 3,675,383; 3,782,058; 4,069,636 and 4,156,993.

G. E. Allen discloses in U.S. Pat. No. 3,782,058 a tying device for tying a wooden board to the uppermost tier of face bricks and a composite face brick and concrete block wall construction. This tying device is stamped from a thin sheet of flat metal stock. It is designed to be installed laterally between the inside faces and the outside faces of masonry blocks and to lie between the butt joints of the concrete. The tying device of this patent includes an elongated body member having opposite flat faces and an upper end and a lower end. The lower end is bent laterally outwardly to define a horizontal anchoring foot integral with the body member. The upper end of the body member is split longitudinally and defines a pair of oppositely horizontally extending tying arms extending from the upper end of the body member perpendicularly in opposite directions therefrom.

M. McColley discloses in U.S. Pat. No. 3,134,197 an elongated spacer member having a rear upright flange portion secured to a structure by which a panel is supported and which underlies the rear face of the panel along the bottom marginal edge portion threof, the bottom of the flange being substantially at the level of the bottom edge of the panel. Also provided is a ledge portion integral with the upright flange portion and projecting forwardly from the bottom thereof, the ledge portion underlying the bottom edge of the panel to support the same. Moreover, there is provided a front upright portion integral with the ledge portion and projecting downwardly from the front thereof to the rim of the associated fixture, the front face of the front upright portion being coplanar with the front face of the panel. In addition, there is provided an integral lip portion projecting obliquely rearwardly and upwardly from the bottom of the front upright portion.

In U.S. Pat. No. 2,648,103, O. Wahlfeld discloses a wall covering for attachment to the sheathing of a wall structure comprising siding pieces arranged for securement to the sheathing and a molding to support in space each successive siding piece in a given relationship with respect to the adjacent attached piece. The molding comprises a stepped section to engage over the attached siding piece with a surface portion thereof in coplanar contact with the fact of the siding piece, and a support section for connection with the next successive siding piece. Deformations are provided in the surface portion of the stepped section of the molding for holding the molding in place on the attached siding piece.

R. Slowinski shows in U.S. Pat. No. 3,102,366 an end joint clip for spanning and supporting the abutting ends of contiguous wall panels on spaced wall panels spanning each end of the joint between said abutting ends to prevent misalignment and sagging of the abutting ends. The clip is adapted to be installed after erection of the contiguous and spaced panels. It is of a construction comprising an elongated and substantially flat rib, bowed along its longer axis into a single substantially convex-concave arch. Furthermore, a substantially flat arm is provided which projects laterally outwardly from the convex side of the rib adjacent each end thereof and which is arranged transversely of the longer axis. A tab is furthermore provided projecting laterally outwardly from the side of each arm remote from the other arm and diverging from the tab on the other arm towards the concave side of the rib.

As will be seen, the aforesaid structures, as well as the structures of the other above-noted patents, differ substantially from the construction of the present invention as described in detail hereinbelow.

SUMMARY OF INVENTION

It is one of the objects of this invention to provide an improved clip construction suitable for use in association with abutting siding sections.

It is still another object of the invention to provide improvements in clip constructions intended for use with siding sections which enable these siding sections to be aligned in coplanar relationship and to prevent warping of the same.

Still another object of the invention is to provide an improved tongue and groove arrangement in adjacent and abutting siding sections to provide a passage therein for accommodating a clip construction, the passage being formed in such a manner as to strengthen the siding material thereat.

Yet another object of the invention is to provide an improved method for mounting panel supported bricks on supporting structures and facilitating the mounting of siding panels in endwise abutting relationship.

In achieving the above and other objects of the invention there is provided a construction which comprises a wall and siding sections on the wall and in coplanar end-to-end relationship and including abutting ends with nesting tongue and groove features to resist relative transverse movement between the siding sections In accordance with the invention the tongue defines a passage extending transversely thereacross and a clip is provided which includes a flat and planar central portion between the sections and extending through the passage in the tongue. The clip includes first and second further portions extending in opposite directions from the central portion along opposite sides of respective of the siding sections. A protruding flange is furthermore provided which extends outwardly from the first further portion such that a settable material adjacent the siding sections is employed in which to embed the protruding flange. In further accordance with a feature of the invention there is provided a a holdback and alignment flange extending from the central portion in opposite direction from the first further portion of the clip for holding one of the siding sections against the wall. The other siding section may be nailed or otherwise fastened directly to the wall. According to various features of the invention the aforementioned central portion of the clip is flat and planar. The siding portions are preferably of plastic foam such that the tongue will include a compressed portion adjacent the passage, the compressed portion resulting from formation of the passage. The siding section along which the further extension extends will preferably define a recess in which the second further section is accommodated. The siding section along which the first further section extends also defines a recess in which the corresponding further section is accommodated.

According to other features of the invention the bricks define intervals therebetween in which the settable material is accommodated. Moreover, one of the siding sections defines a recess to accommodate the holdback and alignment flange mentioned hereinabove. The first further section of the clip and the holdback and alignment flange may be provided according to two embodiments of the invention in either coplanar or offset relationship.

Referring again to the aforementioned passage, this passage according to the invention divides the tongue into spaced sections between which the central portion of the clip is accommodated. According to yet other features of the invention fastening devices such as nails can extend through the second further portion of the clip into the wall or directly through at least one siding section into the supporting structure. The fastening device may be covered by at least one of the bricks which is cemented to the siding section.

According to another aspect of the invention the clip structure in and of itself and divorced from the total wall construction constitutes a novel structure which is not to be derived from the known prior art. Still further, the invention provides a method of developing a wall construction upon which a brick facade is mounted. The method of the invention may comprise preparing siding section ends with a nestable tongue and groove arrangement and compressing a portion of the tongue to form a passage therethrough and to strengthen the same and to accommodate traversal by a clip having a flat central portion with first and second portions extending in opposite directions from opposite ends of the central portion as described above. The method moreover comprises forming the clip with a flange extending from the central portion and in opposite direction from the first further portion mentioned above and bringing the ends of the siding sections towards each other to sandwich the central portion therebetween. This is done while capturing one end between the flange and second further portion of the clip with the central portion of the clip being placed into the aforementioned passage.

In further accordance with the method of the invention the aforementioned tongue is placed in the corresponding groove. In still further accordance with the method of the invention the second further portion may be fastened to a supporting structure and at least one of the siding sections may be fastened directly to this supporting structure. The central portion and passage are made with corresponding widths. In accordance with the invention the siding sections are moreover preferably made of plastic foam and recesses are formed in the foam to receive the aforementioned holdback and alignment flange and the first and second further portions of the clip.

Other objects, features and advantages of the invention will be found in the detailed description which follows hereinbelow as illustrated in the accompanying drawing.

BRIEF DESCRIPTION OF DRAWING

In the drawing:

FIG. 2 is a fragmentary perspective view of a portion of the clip employed in the structure of FIG. 1;

FIG. 4 is a fragmentary view of a portion of the wall structure of FIG. 1, partially in section and partially broken away, with the upper siding section removed illustrating the traversal of the tongue by the central portion of the clip which is employed; and FIG. 5 is a view corresponding to a portion of FIG. 1 illustrating a different arrangement of the holdback and alignment flange with respect to other portions of the clip of the invention.

DETAILED DESCRIPTION

In FIGS. 1–4 is illustrated clip construction 10 of the invention. It is incorporated in a wall construction which appears in the side view shown in FIG. 1. Therein are illustrated foam siding sections 12 and 14 to which have been applied bricks B with intervening settable material 16 such as mortar.

Figure 1:
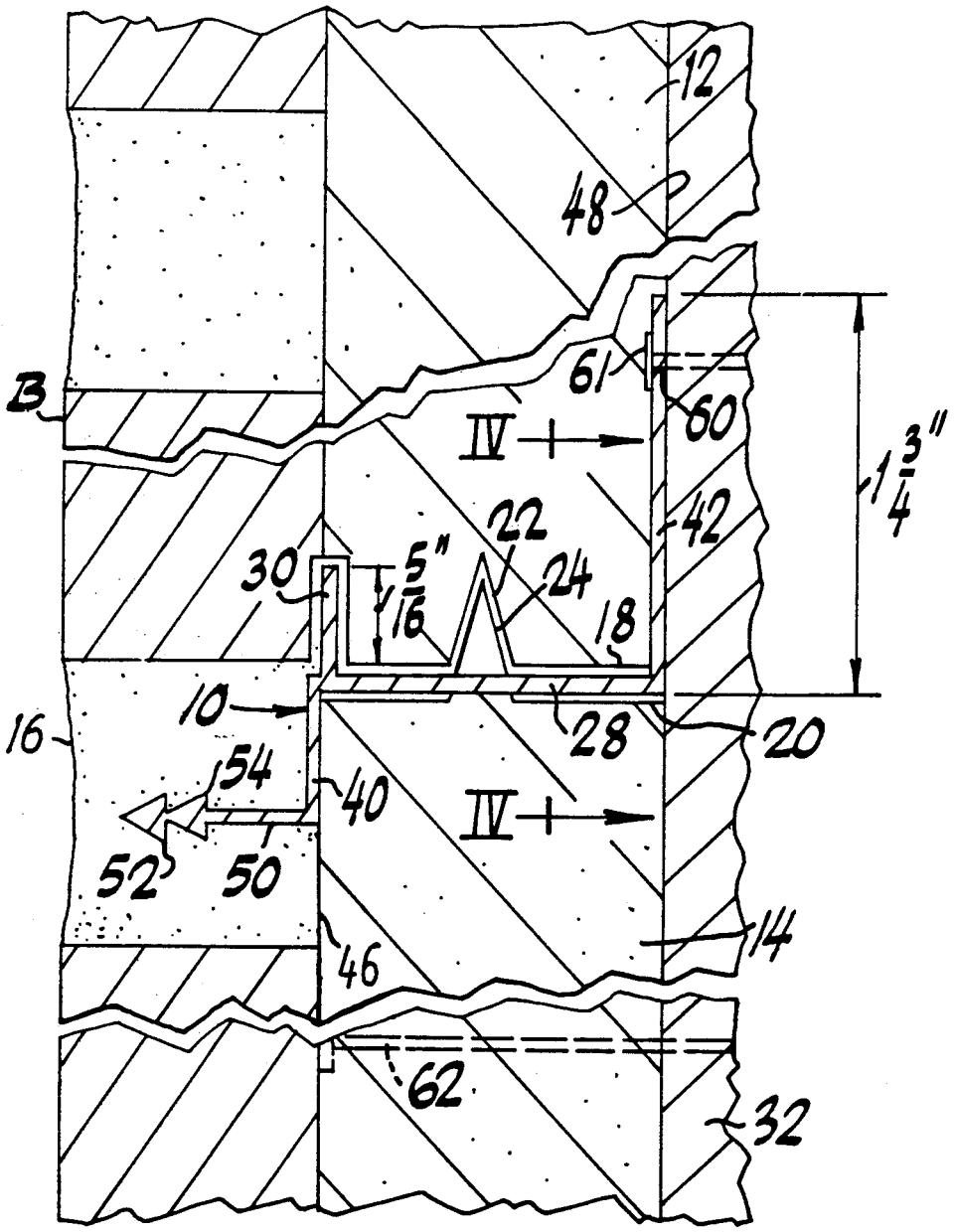
FIG. 1 is a fragmentary section of a wall construction with a brick facade provided in accordance with the invention, a portion of the illustrated structure being broken away and the joint between adjacent siding sections being shown in exploded view to facilitate an understanding of the structure.
Figure 3:
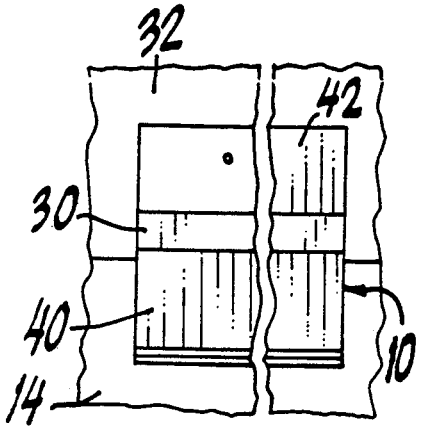
FIG. 3 is a fragmentary view of a front of the clip mounted on a lower siding section with the upper siding section and the tongue of the lower siding section removed to expose the rear wall and the rear portion of the clip affixed to the wall.

Siding sections 12 and 14 have ends 18 and 20 which are in facing and abutting relationship except for the intervention of clip 10 (some spacing is shown in FIG. 1 between ends 18 and 20 and clip 10 for illustrative purposes). The end 18 of siding section 12 is provided with a groove 22. The end 20 of siding section 14 is provided with a tongue or projection 24. Groove 22 and tongue 24 constitute a nesting tongue and groove arrangement which together prevent a relative displacement of sections 12 and 14 transversely of one another. This arrangement is commercially available and well-known and does not require further explanation in this text.

Clip construction 10 includes a planar central portion 28 which is flat and free of projections. Connected at spaced perimetral positions on the central portion 28 are first and second further portions 40 and 42. Preferably, portions 40 and 42 are at least generally perpendicular or othogonal relative to central portion 28. Portions 40 and 42 are preferably parallel to one another and extend in opposite directions away from each other and from the central portion 28.

Portions 40 and 42 are spaced from each other by a distance which may be in the order of magnitude of about one inch and which is such that they engage respective faces of the siding sections 12 and 14. Thus the portion 40 extends along the face 46 of siding section 14 and further portion 42 extends along the face 48 of the section 14. Together with a flange 30, the portions 40 and 42 of the clip construction 10 provide a means for rigorously confining the relative movement between the sections 12 and 14 as a consequence whereof a rigid and welldefined structure is provided. Flange 30 constitutes, at least in part, a holdback and alignment structure which holds back the siding section 12 against wall 32 (e.g., of wood, etc.) and aligns section 12 with siding section 14.

Portion 40 of clip construction 10 is additionally provided with a flange 50. On this flange are located irregularities, protrusions or projections indicated generally at 52 and 54. These protrusions serve as anchors for the material 16 which is a settable material such as mortar which is applied in semi-fluid form and which solidifies into a solid body in which projections 52 and 54 are embedded.

Ridges 52 and 54 protrude in opposite directions from the flange 50 and are parallel to portion 40 as well as to portion 42. The projections extend, for example, about 0.02–0.05 inches to opposite sides of the flange 50.

The clip construction comprising central portion 28 from which extend further portions 40 and 42 and inclusive of flanges 30 and 50 is preferably formed as a monolithic structure molded of plastic such as polyethylene or manufactured, for example, of a metal such as steel or aluminum.

The clip construction of the invention is provided in portion 42 with at least one nail hole as indicated by way of example at 60. Nails or fastening members such as indicated at 61 may be employed to fasten the clip construction in place relative to the associated wall 32.

Nails or fastening members such as indicated at 62 function to prevent withdrawal of the siding sections from the wall 32. Such nails can be concealed by bricks B as illustrated. In the event that the siding sections are supplied with bricks fastened or cemented thereto, the bricks B concealing nails 62 will be initially omitted and will be cemented in place after nails 62 are hammered into place.

As can be seen from the above description, the arrowheads constituting the two parallel ridges on the flange 50 point away from the portion 40 of the clip. Thereby, they function to prevent withdrawal of the settable material 16 and firmly secure the material 16 to the wall 32.

In FIG. 5 is illustrated a variation of the structure of the clip of the invention illustrated in FIG. 1. In FIG. 5 appears siding sections 12′ and 14′ with holdback and alignment flange 30′ and flange 40′ bearing at the lower end thereof flange 50′ with the anchoring structure thereon. Also appearing in this figure is the central portion 28′ of the clip structure. In in coplanar relationship and are accommodated in recesses R1 and R2 which are compressed into the respective ends of siding sections 12′ and 14′. The compressed portions appear at C1 and C2. This is similar to the compressed portion which is made to form the passage which accommodates the central portion of the clip structure. Therefore these recesses are provided with increased strength and rigidity as the foam portions which are compressed or otherwise compacted to form these recesses become denser and therefore more compact and thus become more rigid and gain strength to perform their respective functions.

In accordance with the method of the invention, it will now be understood, there are included the steps of preparing siding section ends with a nestable tongue and groove arrangement, compressing a portion of the tongue to form a passage (FIG. 4) therethrough and to strengthen the same and to accommodate traversal by a clip having a flat central portion and further including first and second portions extending in opposite directions from opposite ends of the central portion. The method further includes forming the clip with a flange extending from the central portion and in opposite direction from the first further portion, bringing the ends towards each other and sandwiching the central portion therebetween while capturing one end between the flange and second further portion of the clip with the central portion of the clip being placed into the passage which is thusly formed.

According to features of the method the tongue is further placed into the aforementioned groove and still further the second further portion may be fastened to a supporting structure.

According to still another feature of the method of the invention at least one of the siding sections may be fastened directly to the supporting structure. Still other features involve the formation of the central portion and passage with corresponding widths. The siding sections are preferably made of plastic foam and recesses are preferably formed in the foam to receive the flange as well as the first and second further portions of the aforementioned clip.

There will now be obvious to those skilled in the art many modifications and variations of the structures and methods set forth hereinabove. These modifications and variations will not depart from the scope of the invention if defined by the following claims:

What is claimed is:

1. A wall construction comprising a wall, siding sections on said wall and in coplanar end-to-end relationship and including abutting ends with nesting tongue and groove means to resist relative transverse movement between said sections, said siding sections having inner and outer faces, said tongue defining a passage extending transversely thereacross, a clip including a central portion between said sections and extending through said passage in said tongue, said clip including first and second further portions extending in opposite directions from said central portion along opposite sides of respective of the siding sections, protruding means extending outwardly from the first further portion, a suitable material adjacent the siding sections and in which said protruding means is embedded, and holdback and alignment means extending from said central portion in opposite direction from said first further portion of the clip for holding one of the siding sections against the wall, said holdback and alignment means engaging the outer face of said one siding section.

2. A wall construction as claimed in claim 1 wherein said protruding means includes a flange on and extending from said first further portion and at least one ridge extending along said flange and spaced from and at least generally parallel to said first further portion.

3. A wall construction as claimed in claim 1 wherein said central portion is flat and planar.

4. A wall construction as claimed in claim 1 wherein said siding portions are of plastic foam.

5. A wall construction as claimed in claim 4 wherein said siding section including said tongue includes a compressed portion adjacent said passage.

6. A wall construction as claimed in claim 1 wherein the siding section along which the second further section extends defines a recess in which the second further section is accommodated.

7. A wall construction as claimed in claim 1 wherein the siding section along which the first further section extends defines a recess in which the first further section is accommodated.

8. A wall construction as claimed in claim 1 comprising bricks on the siding sections, said bricks defining intervals therebetween in which the settable material is accommodated.

9. A wall construction as claimed in claim 7 wherein the siding section along which the second further section extends defines a recess in which the second further section is accommodated.

10. A wall construction as claimed in claim 1 wherein said one siding section defines a recess to accommodate said holdback and alignment means.

11. A wall construction as claimed in claim 6 wherein the siding section defining the recess includes a compressed portion bordering at least part of the recess.

12. A wall construction as claimed in claim 7 wherein the siding section defining the recess includes a compressed portion bordering at least part of the recess.

13. A wall construction as claimed in claim 10 wherein said one siding section includes a compressed portion bordering at least part of the recess.

14. A wall construction as claimed in claim 1 wherein said passage divides the tongue into spaced sections between which the central portion of the clip is accommodated.

15. A wall construction as claimed in claim 1 comprising fastening means extending through the second portion into said wall.

16. A wall construction as claimed in claim 8 comprising fastening means extending through at least one siding section into the wall.

17. A wall construction as claimed in claim 16 wherein the fastening means is covered by at least one said bricks.

18. A clip construction adapted for retaining a body material against a wall which includes siding sections in generally endwise abutting relation, said clip construction comprising a flat central portion adapted to be positioned between said siding sections, first and second further portions extending angularly from the central portion at spaced positions on the central portion and being adapted to extend along opposite sides of said siding section, protruding means on said first further portion and adapted for being embedded in said body to retain said body against said wall, said second further portion being adapted for connection to the wall, and holdback and alignment means extending from said central portion in substantial alignment with said first further portion and in opposite direction from said first further portion and adapted for holding one of the siding sections against the wall.

19. A clip construction as claimed in claim 18 wherein said further portions are at least generally parallel but offset.

20. A clip construction as claimed in claim 19 wherein said holdback and alignment means includes a flange spaced from the parallel to said second further portion.

21. A clip construction as claimed in claim 20 wherein the flange of said holdback and alignment means is coplanar with said first further portion.

22. A clip construction as claimed in claim 20 wherein the flange of said holdback and alignment means is offset from said first further portion.

23. A clip construction as claimed in claim 22 wherein the flange of said holdback and alignment means is flat.

24. A method comprising preparing siding section ends with a nestable tongue and groove arrangement, said siding sections having inner and outer faces and having spaced brick sections on the outer face, compressing a portion of the tongue to form a passage therethrough and to strengthen the same and to accommodate transversal by a clip having a flat central portion and first and second portions extending in opposite directions from opposite ends of the central portion, forming said clip with a flange extending from the central portion and in opposite direction from said first further portion and also with a protrusion adapted to extend between said brick sections, bringing the ends towards each other and sandwiching the central portion therebetween while capturing one end between said flange and second further portion of the clip with the central portion of the clip being placed into said passage and with said flange engaging the outer face of one of said siding sections, and inserting a suitable material between the brick sections and in engagement with said protrusion.

25. A method as claimed in claim 24 wherein the tongue is placed in said groove.

26. A method as claimed in claim 25 wherein the second further portion is fastened to a supporting structure.

27. A method as claimed in claim 26 wherein at least one of said siding sections is fastened directly to said supporting structure.

28. A method as claimed in claim 26 wherein the central portion and passage are made of corresponding width.

29. A method as claimed in claim 26 wherein the siding sections are made of plastic foam and recesses are formed in the foam to receive said flange and said first and second further portions of said clip.

* * * * *